United States Patent [19]

Detournay et al.

[11] Patent Number: 4,595,477

[45] Date of Patent: Jun. 17, 1986

[54] ELECTROLYSIS CELL

[75] Inventors: Jean-Paul Detournay, Franiere; Emile Cabaraux, Brussels, both of Belgium

[73] Assignee: Solvay & Cie, Brussels, Belgium

[21] Appl. No.: 637,415

[22] Filed: Aug. 3, 1984

[30] Foreign Application Priority Data

Aug. 18, 1983 [LU] Luxembourg ..... 84973

[51] Int. Cl.[4] ..... C25B 9/00; C25B 11/02; C25B 13/02; C25B 15/08

[52] U.S. Cl. ..... 204/253; 204/282

[58] Field of Search ..... 204/98, 128, 252–258, 204/263–266, 279, 280, 282, 286

[56] References Cited

U.S. PATENT DOCUMENTS

| | | | |
|---|---|---|---|
| 3,983,026 | 9/1976 | Cabaraux et al. | 204/258 |
| 4,121,990 | 10/1978 | Boulton | 204/98 |
| 4,152,225 | 5/1979 | Woodward, Jr. et al. | 204/98 |
| 4,175,024 | 11/1979 | Darlington | 204/252 |
| 4,229,277 | 10/1980 | Specht | 204/252 |
| 4,278,523 | 7/1981 | Byrd et al. | 204/252 |
| 4,329,217 | 5/1982 | Byrd et al. | 204/252 |
| 4,417,970 | 10/1983 | Yamaguchi et al. | 204/283 |

FOREIGN PATENT DOCUMENTS

| | | | |
|---|---|---|---|
| 872994 | 7/1961 | United Kingdom | 204/252 |
| 2079318 | 1/1982 | United Kingdom | 204/252 |

*Primary Examiner*—Andrew H. Metz
*Assistant Examiner*—Terryence Chapman

[57] ABSTRACT

Electrolysis cell incorporating, in an enclosure, electrodes (17) each of which passes, in a leaktight manner, through an individual opening (16) in a wall (4) of the enclosure and each of which is surrounded by an individual bag-shaped tubular separator (20) engaged in a leaktight manner in the abovementioned opening in the wall.

12 Claims, 4 Drawing Figures

ELECTROLYSIS CELL

The present invention is aimed at improving electrolysis cells incorporating, in an enclosure, an alternation of anodes and cathodes isolated from each other by separators, such as permeable diaphragm cells and cells with a membrane with selective permeability which are intended for the electrolysis of aqueous solutions of sodium chloride.

It relates more particularly to an electrolysis cell incorporating, in an enclosure, electrodes, each of which passes, in a leaktight manner, through an individual opening in a wall of the enclosure and each of which is surrounded by an individual tubular separator engaged in a leaktight manner in the abovementioned opening in the wall.

An electrolysis cell of this type, in which the separators are diaphragms which are permeable to aqueous electrolytes, is described in Pat. No. GB-A-872,994 (Veb Farbenfabrik Wolfen). This known cell incorporates, in an enclosure, vertical anodes alternating with tubular cathodes having a perforated metal wall, which pass at one end through a side wall of the enclosure and are supported, at their other end, in a slot arranged in the opposite side wall of the enclosure. Each tubular cathode is wholly encased in a tubular diaphragm which extends between the two above-mentioned side walls of the enclosure and is firmly fixed thereto in a leaktight manner.

In the construction of this known cell, it is found to be difficult to ensure effectively a leaktight fixing of the diaphragm in the abovementioned slot in the enclosure wall because access to this slot is difficult.

The invention overcomes this disadvantage of the known cell described above, by providing an electrolysis cell incorporating electrodes surrounded by individual sleeve-shaped separators, in which cell the zones for leaktight fixing of the separators in an enclosure of the cell are all easily accessible.

The invention consequently relates to an electrolysis cell incorporating, in an enclosure, electrodes, each of which passes, in a leaktight manner, through an individual opening in a wall of the enclosure and each of which is surrounded by an individual tubular separator engaged in a leaktight manner in the abovementioned opening in the wall; according to the invention, the individual tubular separator of each electrode has the shape of a bag which completely encloses the electrode in the enclosure.

In the cell according to the invention, the contour of the electrodes is not critical, the latter being capable of being of any shape which is compatible with the purpose of the cell. Each of the electrodes, for example, may consist of a planar unit metal plate, perforated or solid, or may incorporate a pair of plates or of planar metal grids, arranged facing each other, or a series of elongated sheets arranged successively facing each other; they may be tubular electrodes with perforated walls, for example made of metal mesh, with a cross-section which is circular, oval or polygonal, for example rectangular. They may be either anodes or cathodes of the cell and, in this case, be made of any conductive material suitable for the electrode reaction which is to take place thereat when the cell is in operation. Thus, in the case of cathodes for the electrolylsis of aqueous sodium chloride solutions, they may be made, for example, of mild steel or nickel, while in the case of anodes for the electrolysis of such solutions, they may advantageously be made of titanium or another film-forming metal of the titanium group, carrying an active conductive coating incorporating a metal of the platinum group or a compound of a metal of the platinum group.

The function of the separator by which each of the electrodes is surrounded is to isolate the said electrode from the remaining part of the enclosure. It must be made of a material which can permit an ion stream to cross it during the operation of the cell and, for this purpose, it may be either a diaphragm which is permeable to aqueous electrolytes or a selective permeability membrane.

Examples of diaphragms which may be employed in the cell according to the invention are asbestos diaphragms, such as those described in the U.S. Pat. No. 1,855,497 (Stuart), British Pat. No. 2,003,182 (Solvay & Cie) and U.S. Pat No. 4,204,941 (assigned to Solvay & Cie) and organic polymer diaphragms, such as those described in U.S. Pat No. 3,890,417 (assigned to Imperial Chemical Industries Ltd) and in European Pat Nos. 7,674 and 37,140 (Solvay & Cie).

A selective permeability membrane is understood to be a thin, non-porous membrane incorporating an ion exchanger substance. The choice of the material forming the membrane and of its ion exchanger substance will depend on the nature of the electrolytes subjected to electrolysis and the products which it is intended to obtain. As a general rule, the membrane material is chosen from among those which are capable of withstanding the thermal and chemical conditions normally existing in the cell during the electrolysis, the ion exchanger substance being chosen from among the substances which exchange anions or substances which exchange cations, depending on the electrolysis operations for which the cell is intended. For example, in the case of cells intended for the electrolysis of aqueous sodium chloride solutions for the manufacture of chlorine, hydrogen and aqueous sodium hydroxide solutions, membranes which are highly suitable are cationic membranes of a fluorine-containing polymer, preferably perfluorinated, containing functional cationic groups derived from sulphonic acids, carboxylic acids or phosphonic acids, or mixtures of such functional groups. Examples of membranes of this type are those described in British Pat. Nos. 1,497,748 and 1,497,749 (ASAHI KASEI KOGYO K.K.), 1,518,387 and 1,522,877 (ASAHI GLASS COMPANY Ltd.) and 1,402,920 (DIAMOND SHAMROCK CORP.) and in U.S. Pat. No. 4,126,588 (assigned to ASAHI GLASS COMPANY Ltd.).

Membranes which are particularly suitable for this application of the cell according to the invention are those known under the names "NAFION" (DU PONT DE NEMOURS & Co) and "FLEMION" (ASAHI GLASS COMPANY Ltd).

According to the invention, the individual tubular separator of each electrode is a bag which completely encloses the electrode in the cell enclosure. For this purpose, it is generally shaped as a tube which is closed hermetically at one end, while at the other end it is open to permit the electrode to be inserted therein.

Thus, in the cell according to the invention, the separators have a finger-like contour, so that each of them requires only a single leaktight fixing to the enclosure wall, access to this fixing being, moreover, easy.

In a particular embodiment of the cell according to the invention, each of the electrodes incorporates a pair of plates arranged facing each other in the bag forming the separator, on either side of a rigid insert bar arranged in the abovementioned opening of the wall, and a component for the leaktight sealing of the passage of the said electrode and its separator in the opening incorporates a pair of pliable ring seals one of which is compressed between the separator and the insert bar and the other of which is compressed between the separator and the wall. In this embodiment of the invention, both leaktight seals may be made of any elastic and inert materials which are capable of withstanding the chemical and thermal environment normally existing in the electrolysis cell during its use; their mechanical strength and their elasticity must be sufficient to enable them to withstand the internal pressure in the cell and to ensure effective leaktight sealing of the latter.

In the embodiment just described the two leaktight seals are preferably arranged facing each other, on either side of the separator, a clamp compressing the outer seal, which preferably has a circular cross-section, against the membrane and the wall of the enclosure in the opening of the latter.

In the cell according to the particular embodiment just described it is easy to connect the electrodes in parallel to a busbar arranged outside the enclosure, by means of electrical conductors integrally fixed respectively to said insert bars of the electrodes.

The invention applies equally to electrolysis cells with vertical, horizontal or oblique electrodes.

In the case of a cell with vertical electrodes, the enclosure wall through which the electrodes pass may be a vertical side wall, or the bottom wall of the enclosure, or an upper horizontal wall of the enclosure. A preferred cell is one in which this is an upper horizontal wall, and more especially a removable cover of the enclosure, from which the electrodes and their respective tubular separators are then suspended.

Individual features and details of the invention will become apparent from the following description of the attached drawings which show diagrammatically a particular embodiment of the cell according to the invention.

BRIEF DESCRIPTION OF THE DRAWINGS

In these Figures, the same reference numerals indicate identical elements.

Figure 1:
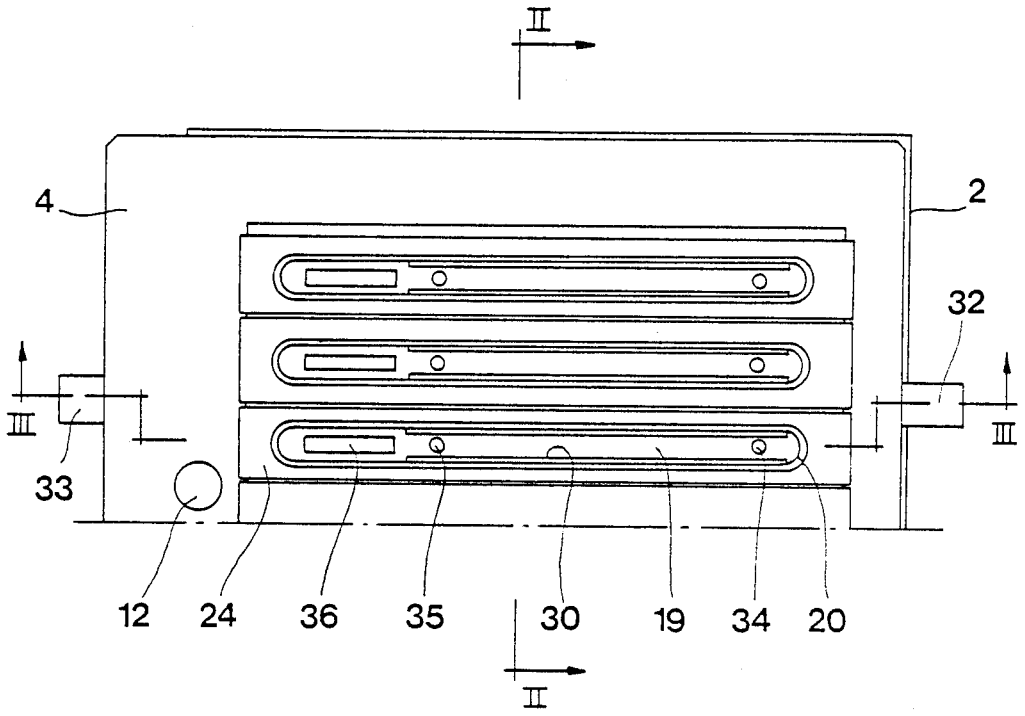
FIG. 1 is a plan view of a part of the cell.

The cell shown in the figures is a cell with a selective permeability membrane for the electrolysis of aqueous sodium chloride solutions. It incorporates (FIGS. 2 and 3) an enclosure placed on a base 1 and consisting of a titanium horizontal bottom plate 2, a casing 3 placed vertically at the periphery of the plate 2 and a cover 4. Pliable ring joints 5 and 6 ensure leaktight sealing between the bottom plate 2, the casing 3 and the cover 4. The casing 3 and its cover 4 are made of a material which withstands chlorine and brines under the normal operating conditions of electrolysis cells. In the enclosure, vertical anodes 7 alternate with vertical cathodes 17.

Each anode 7 is formed by a pair of vertical titanium plates 8, perforated if appropriate, carrying a coating of a conductive material with low discharge over-voltage for chloride ions in an aqueous solution, for example a mixture of ruthenium oxide and titanium dioxide. The fixing of the anodes 7 in the cell and their supply with electric current are implemented in the manner described in U.S. Pat. No. 3,983,026 (assigned to SOLVAY & Cie). For this purpose, the two vertical plates 8 of each anode 7 are welded together on a series of cylindrical titanium rods 9 which pass through the bottom plate 2 in a leaktight manner and are fixed to a rigid plate 10 made of copper or aluminium which rests on fixed supports 11 under the bottom plate 2 and which is connected to the positive terminal of a source of direct current, not shown.

The cover 4 is pierced by elongated openings 16 (FIGS. 2 and 3), uniformly spaced relative to each other, into which are inserted the individual vertical cathodes 17. The cathodes 17 are tubular in shape and, for this purpose, each of them consists of a nickel grid which is arranged so as to have two planar vertical lengthwise faces facing the anode plates 8, connected by curved vertical transverse faces; each grid 17 is suspended from a horizontal insert bar 19, also made of nickel.

Figure 2:
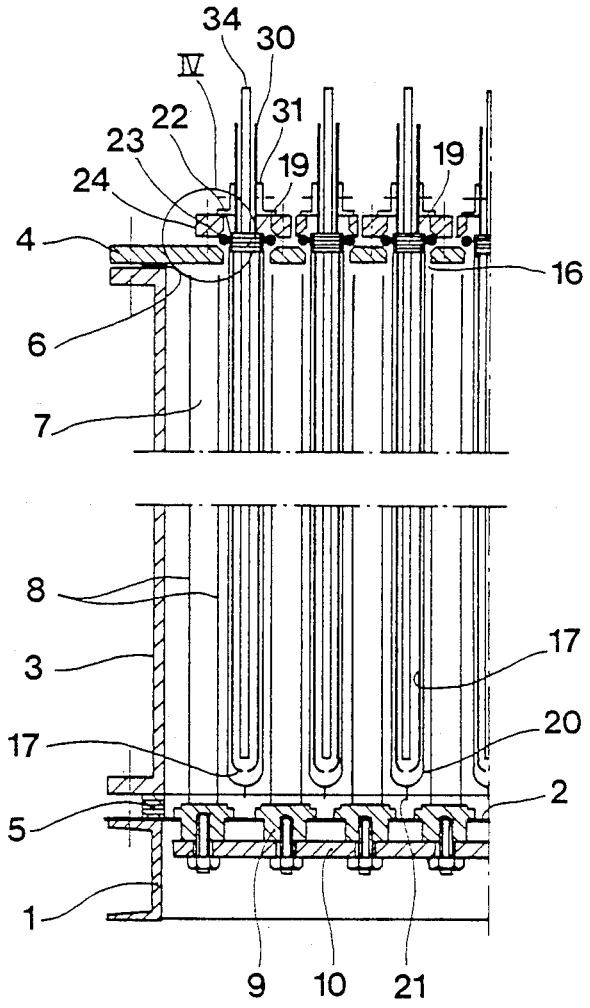
FIG. 2 is a vertical cross-section along the plane II—II of FIG. 1.
Figure 3:
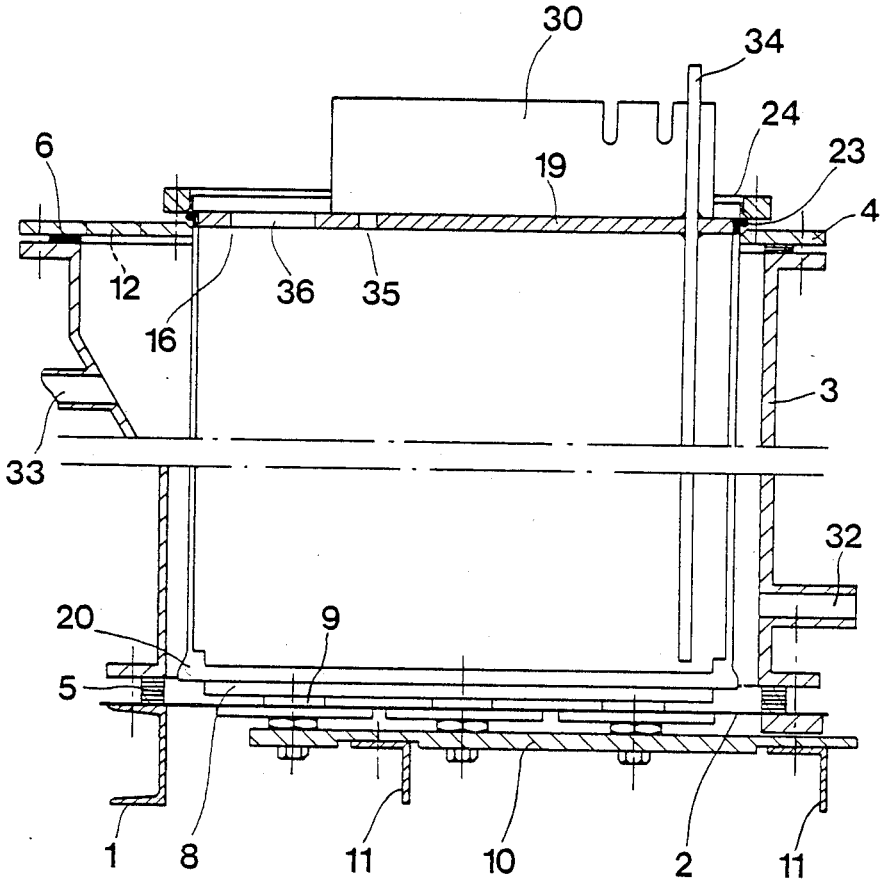
FIG. 3 is a vertical cross-section along the plane III—III of FIG. 1.

Each cathode 17 is wholly surrounded with a cationic membrane 20 as described above, in the shape of a tubular or finger-shaped bag closed at its lower end 21 (FIG. 2).

Figure 4:
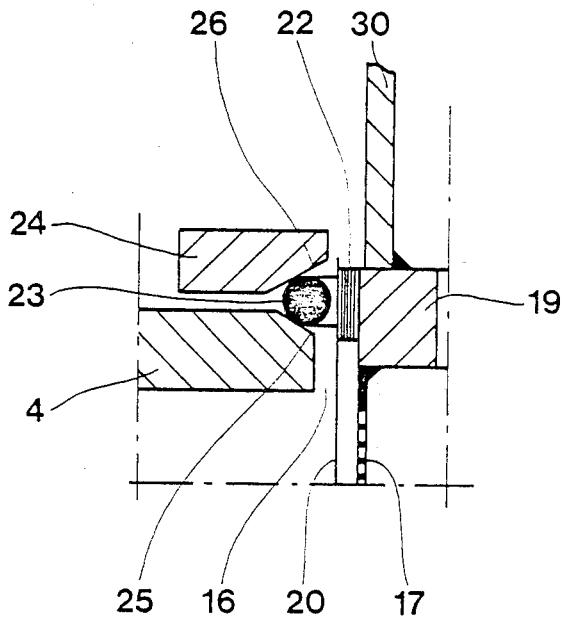
FIG. 4 shows, on a larger scale, a detail outlined by the circle IV in FIG. 2.

The leaktight sealing of the passage of each cathode 17 and its membrane 20 in the corresponding opening 16 of the cover 4 is ensured by means of a leaktight sealing member which incorporates (FIG. 4) a first pliable ring seal 22 arranged around the insert bar 19, between the latter and the bag forming the membrane 20, a second pliable ring seal 23 which is arranged around the bag forming the membrane 20, at the height of the seal 22, and a metal ring 24 employed as a clamp and fixed firmly to the cover 4 by any suitable means, for example a nut and bolt assembly, to clamp the two seals 22 and 23 and the membrane 20 against the insert bar 19 and the cover 4, at the periphery of the opening 16. In order to guarantee a durable leaktignt sealing, the seal 22 is preferably given a rectangular cross-section and the seal 23 a circular cross-section. It is, moreover, especially advantageous that the surface 25 of the cover 4 bearing on the seal 23 and the surface 26 of the clamping ring 24 bearing on the seal 23 have divergent gradients directed towards the insert bar 19 (FIG. 4).

The seals 22 and 23 must be made of materials which are capable of withstanding the pressure and the chemical and thermal conditions existing respectively in the cathode chambers 28 and in the anode chamber 29 of the cell; more particularly, the material chosen for seal 22 must be capable of withstanding concentrated aqueous sodium hydroxide solutions, while the material of seal 23 must be capable of withstanding chlorine and concentrated aqueous sodium chloride solutions.

The electrical supply to the cathodes 17 is provided by means of copper or aluminium bars 30, welded in pairs to the insert bars 19 and connected in parallel to a busbar, not shown, joined to the negative terminal of the abovementioned source of direct current.

To guarantee correct positioning of the cathodes 17 in the cell, they may advantageously be firmly fixed to the cover 4 through the intermediacy of angle brackets 31 fixed to the bars 30 and to the rings 24 (FIG. 2).

The casing 3 is equipped (FIGS. 1 and 3) with pipework 32 for introducing a concentrated, preferably saturated, solution of sodium chloride and pipework 33 for withdrawing a dilute solution of sodium chloride; the chlorine produced at the anode plates 8 is removed through the orifices 12 in the cover 4.

The insert bar 19 of each cathode 17 is crossed by a vertical tube 34 for the entry of water or a dilute sodium hydroxide solution (containing, for example, 10% by weight of sodium hydroxide) and is pierced by an opening 35 serving for removing a concentrated sodium hydroxide solution (containing, for example from 25 to 40% by weight of sodium hydroxide), produced during the electrolysis; the hydrogen formed at the cathodes 17 is removed through an orifice 36 in the insert bar 19.

In an advantageous alternative form of the electrolysis cell which has just been described, with reference to FIGS. 1 to 4, the insert bars 19 consist of a copper or aluminum core and a nickel sheath which are assembled by the known technique of coextrusion. In this alternative form of the invention, the nickel sheath may completely cover the copper or aluminium core. It is preferable, however, to employ insert bars 19 in which the nickel sheath does not cover the upper face of the core, in order to facilitate the welding of the bars 30.

To construct the cell shown in the figures, the anodes 7 and the bottom plate 2 are assembled, the casing 3 is placed on the bottom plate 2 and the cover 4 is fixed to it. Each cathode 17 is fixed separately to its ring 24 by means of the angle brackets 31, is inserted into its bag-shaped membrane 20, and the seals 22 and 23 are arranged around the insert bar 19. The cathodes and their corresponding membranes are then inserted into the casing 3 through the openings 16 and the rings 24 are firmly fixed to the cover 4 to compress the seals 22 and 23.

We claim:

1. An electrolysis cell comprising an enclosure having a wall with a plurality of openings, a plurality of electrodes in said enclosure, each of said electrodes passing individually through a respective one of said openings, an individual tubular separator surrounding each of said electrodes, said separator being in the shape of a bag which wholly encloses the portion of said each electrode that is in said enclosure and which has an open end portion through which said each electrode is inserted and which extends in the respective opening for said each electrode and means for providing a leak-tight seal between said end portion of said each separator and the respective electrode and between said end portion of said each separator and the portion of said enclosure wall surrounding said respective opening.

2. A cell according to claim 1, in which each of said electrodes comprises a pair of plates facing each other and a rigid bar inserted between said plates and disposed in the respective one of said openings through which said each electrode passes, and in which said means providing a leak-tight seal comprises a first ring seal compressed between said separator and said insert bar and a second ring seal comprised between said separator and said wall.

3. A cell according to claim 2, in which said two seals are arranged facing each other on opposite sides of said separator and in which said second ring seal has a circular cross section and is compressed between the separator, a face of said respective opening, which face slopes toward said separator and a rigid ring surrounding said opening and secured to said wall.

4. A cell according to claim 3, in which the two plates of said each electrode are firmly fixed to the respective insert bar for which in turn is attached to the respective rigid ring.

5. A cell according to claim 3, in which said electrodes are coupled in parallel to a bushbar arranged outside said enclosure by electrical conductors firmly connected respectively to said insert bars of said electrodes.

6. A cell according to claim 1, in which said wall comprises an upper horizontal wall of said enclosure and in which said electrodes with their respective separators are suspended vertically from said wall.

7. A cell according to claim 6, in which said wall is a removable cover of said enclosure.

8. A cell according to claim 6, in which said electrodes are cathodes and alternate with vertical and parallel anodes in said enclosure.

9. A cell according to claim 8, in which said cell is a cell for the electrolysis of aqueous sodium chloride solutions.

10. A cell according to claim 1, in which said separator is a selectively permeable membrane.

11. An electrolysis cell comprising an enclosure having a wall with a plurality of openings, a plurality of electrodes in said enclosure, each of said electrodes being in line with a respective one of said openings, a rigid bar attached to each of said electrodes and received in each respective one of said openings, a tubular separator surrounding each of said electrodes, said separator being in the form of a bag which wholly encloses the portion of the respective electrode that is in said enclosure and having an open end portion to receive said electrode, said open end portion being disposed in said respective opening and surrounding said rigid bar and sealing means for providing a leaktight seal between said end portion of said separator and said rigid bar and between said end portion of said separator and a portion of said wall surrounding said respective opening.

12. A cell according to claim 11, in which said sealing means comprises a pair of pliable rings one of which is compressed between said separator and said rigid bar of the respective electrode and the other of which is compressed between said wall and said separator.

* * * * *